US005399033A

United States Patent [19]

Putman

[11] Patent Number: 5,399,033

[45] Date of Patent: Mar. 21, 1995

[54] RE-INKABLE RIBBON CARTRIDGE

[75] Inventor: Allen W. Putman, Franklin, Tenn.

[73] Assignee: Pelikan, Inc., Franklin, Tenn.

[21] Appl. No.: 180,719

[22] Filed: Jan. 13, 1994

[51] Int. Cl.[6] ..... B41J 27/12

[52] U.S. Cl. ..... 400/197; 400/196.1

[58] Field of Search ..... 400/197, 196.1, 194, 400/202.2, 202.4

[56] References Cited

U.S. PATENT DOCUMENTS

| | | | |
|---|---|---|---|
| 4,364,678 | 12/1982 | Ogan | 400/202.2 |
| 4,465,388 | 8/1984 | Iwasawa | 400/202.1 |
| 4,616,942 | 10/1986 | Nagasawa et al. | 400/196.1 |
| 4,636,097 | 1/1987 | Goubeaux | 400/197 |
| 4,747,711 | 5/1988 | Motta et al. | 400/196.1 |
| 4,747,713 | 5/1988 | Kikuchi et al. | 400/196.1 |
| 4,838,715 | 6/1989 | Ishikawa | 400/196.1 |
| 4,913,571 | 4/1990 | Rulson | 400/196.1 |
| 4,988,225 | 1/1991 | Huang et al. | 400/196.1 |
| 5,195,834 | 3/1993 | Matsuo | 600/202 |

FOREIGN PATENT DOCUMENTS

| | | | |
|---|---|---|---|
| 0007373 | 1/1991 | Japan | 400/197 |

*Primary Examiner*—Edgar S. Burr

*Assistant Examiner*—Anthony H. Nguyen

*Attorney, Agent, or Firm*—John F. A. Earley; John F. A. Earley, III

[57] ABSTRACT

A re-inkable ribbon cartridge for use in a printing device for printing on a sheet of paper and obtaining a consistent darkness of print. The ribbon cartridge has a base member with an exit arm and an entrance arm extending from the base member with a print space between ends of the arms. A ribbon storage chamber is formed in the base member, and an ink ribbon extends from the ribbon storage chamber and through the exit arm, the print space, and the entrance arm to return to the ribbon storage chamber. A drive wheel is mounted in the cartridge for moving the ribbon out of the storage chamber with a press wheel that presses the ribbon against the drive wheel and meters ink onto the ribbon. An ink reservoir chamber is formed in the cartridge, and a foam pad containing ink is positioned in the ink reservoir chamber. A wick extends from the foam pad and contacts the press wheel to transfer ink by capillary action from the foam pad to the press wheel which meters the ink onto the ribbon. A spring presses the wick against the press wheel.

6 Claims, 1 Drawing Sheet

RE-INKABLE RIBBON CARTRIDGE

BACKGROUND OF THE INVENTION

1. Field of the Invention

The present invention relates to a ribbon cartridge for printing devices including typewriters and printers, and is more particularly concerned with ribbon cartridges which have endless ribbons that are re-inkable.

2. Description of the Prior Art

A problem with a number of conventional ink ribbon cartridges or cassettes in use today with typewriters and printers is that the darkness of the print fades during the life of the ribbon.

In several of the conventional cartridges, the ribbon ink that is being depleted during printing is replenished through a reservoir of ink held in either a foam pad or in a circular foam roll. The ink is transferred onto the fabric ribbon by applying the ink from the foam pad or foam roll to a transfer roller that meters the ink from the transfer roller to the fabric ribbon. This keeps the ink from puddling in one spot on the ribbon when it sits idle between print sessions. However, this structure does not provide a solution to the problem of maintaining a uniform darkness of the print during the life of the ink ribbon cartridge.

SUMMARY OF THE INVENTION

The present invention solves the problem of maintaining a uniform darkness of print during the life of the cartridge by providing an ink reservoir pad which holds a supply of ink, a wick which extends from the ink reservoir pad to provide for capillary flow of the ink do a press wheel which meters the ink onto the ribbon, and a spring which presses the wick against the press wheel.

DETAILED DESCRIPTION OF THE DRAWINGS

Figure 1:
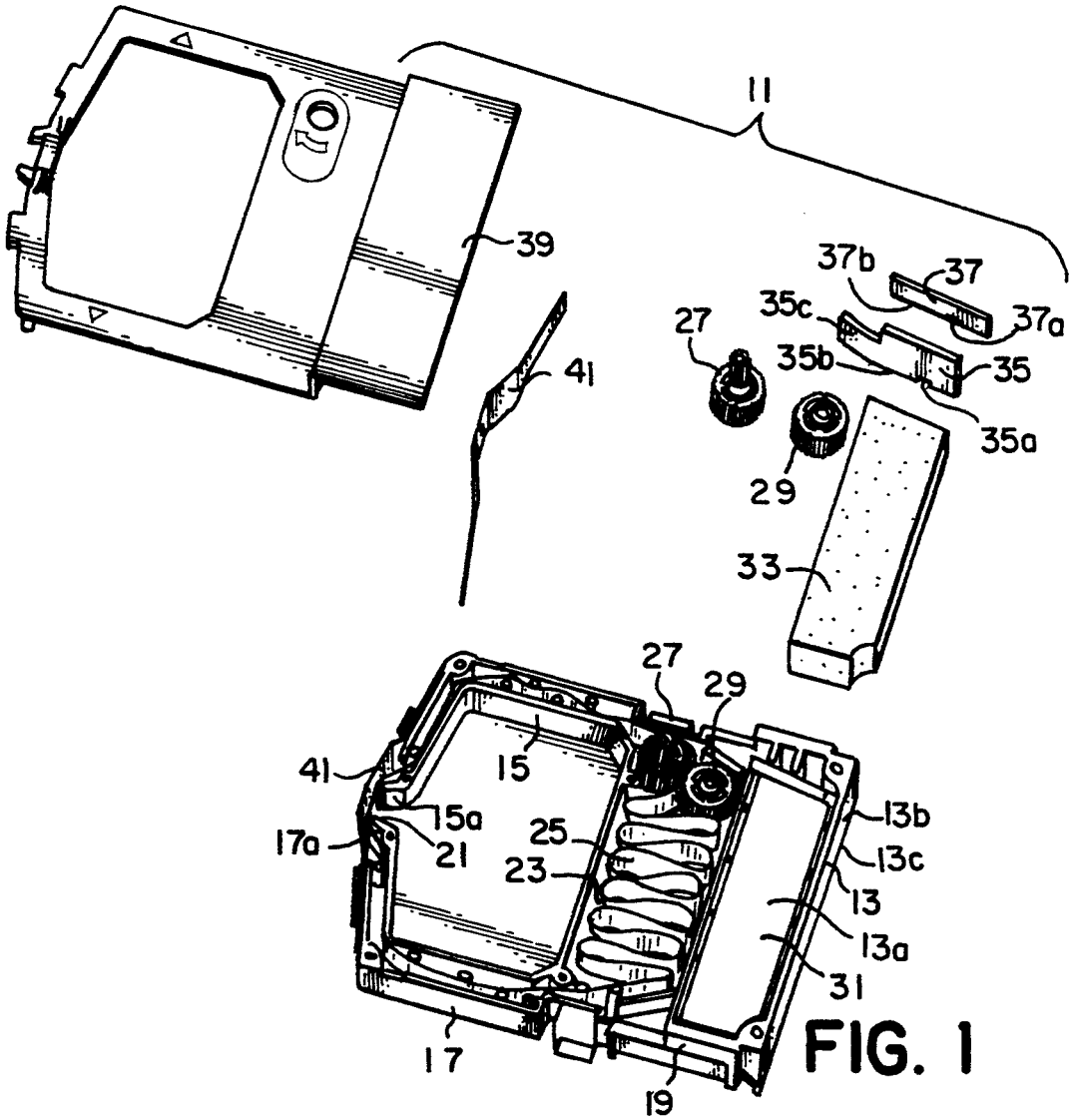
FIG. 1 is an exploded view of an ink ribbon cartridge constructed in accordance with this invention.
Figure 2:
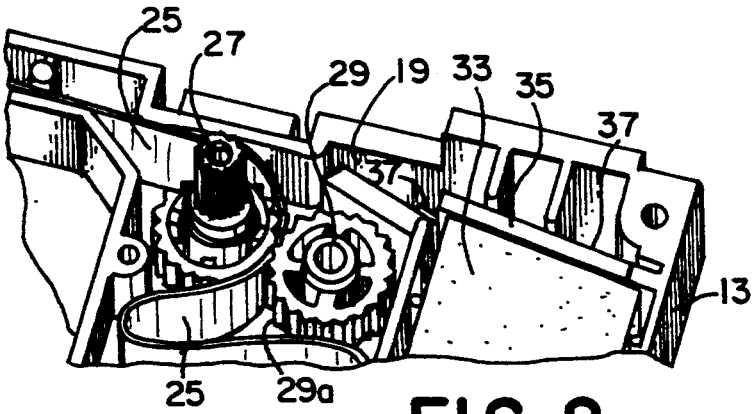
FIG. 2 is a view in partial assembly in perspective of the re-inkable cartridge of the invention.

Turning now to the drawings, there is shown a re-inkable ribbon cartridge or cassette 11 for use in a printing device such as a typewriter or printer for printing on a sheet of paper. Ribbon cartridge 11 comprises a case 13 having a base member 19. An exit arm 15 and an entrance arm 17 extend from the base member 19. Case 13 has a bottom wall 13*a* and an upstanding sidewall 13*b* extending upwardly from the periphery 13*c* of the bottom wall 13*a*. There is a print space 21 between end 15*a* of exit arm 15 and end 17*a* of entrance arm 17.

A ribbon storage chamber 23 is formed in base member 19 to hold an ink ribbon 25 which may be made of nylon and which passes from ribbon storage chamber 23 through the exit arm 15, through the print space 21, and returns to the ribbon storage chamber 23 through the entrance arm 17.

A drive wheel 27 is mounted in the base member 19 for moving the ribbon 25 out of the storage chamber 23, and a press wheel 29 helps to move the ribbon 25 by pressing the ribbon 25 against the drive wheel 27 so that the ribbon is pinched between the drive wheel 27 and press wheel 29 to pull the ribbon 25 out of the storage chamber 23.

Press wheel 29 also provides for metering and transferring ink to the ribbon 27.

An ink reservoir chamber 31 is formed in the base member 19, and contains a foam pad 33 which is filled with ink. A wick 35 extends from the foam pad 33 and contacts the press wheel 29 to transfer ink by capillary action from the foam pad 33 through the wick 35 and into the teeth 29*a* of press wheel 29. Wick 35 has a positioning notch 35*a* in its lower edge 35*b*, and has a reduced portion 35*c* at its forward end portion.

A leaf spring 37 is provided for pressing the wick 35 against the press wheel 29 and this assists in obtaining constant or consistent darkness of print. Spring 37 has a positioning notch 37*a* in its lower edge 37*b*, and case 13 has a positioning ridge formed on the upper surface of bottom wall 13*a* for receiving the positioning notch 37*a* of the spring 37.

A cover 39 is provided for covering the case 13.

While leaf spring 37 is shown as a flat leaf spring made of stainless steel which applies force to the press wheel 29, a compression spring or a leaf spring made of other stiff material may be used to press the wick 35 against the press wheel 29.

In operation, the wick 35 transfers ink from the foam pad 33 to the teeth 29*a* of press wheel 29 which transfers the ink to the ribbon 25 as it passes between press wheel 29 and drive wheel 27. The metering teeth 29*a* of the press and transfer wheel 29 pick up a metered amount of ink from the wick 35 which receives only a certain amount of ink because of the capillary action. This keeps the ink from puddling on one spot on the ribbon when the press and transfer wheel 29 sits idle between print sessions, as it would if the ribbon were in direct contact with a foam pad or roll.

As shown in the drawings, a polyester ribbon shield 41 is mounted on ends 15*a*, 17*a* of exit arm 15 and of entrance arm 17 across the print space 21. The ribbon 25 may be made of nylon, and the case 13, cover 39, and drive wheel 27 may be made of a synthetic resin plastic such as ABS.

The ink used in foam pad 33 is preferably a black matrix ink containing fatty acids, fatty esters, and a black dye. It has a viscosity of about 325 cps at 78° F., a boiling point over 300° F., is insoluble in water and may be obtained from N.H. Labo, Harrisburg, Pa., as their catalog number 900A 0% black matrix ink.

The foam for foam pad 33 may be reticulated polyester polyurethane open pore foam, tensile strength about 50–110 psi, ultimate elongation about 250–350%, tear strength about 5–18 lb/inch, about 90 pores per linear inch, and may be obtained from Scotfoam, Eddiptone, Pa. as their catalog number 4-900Z. The permeability of the foam at 0.5 in. of water pressure equals about 65–200 cfm/sq.ft. using test procedure ASTM D3574.

The wick material for wick 35 is preferably Porex XN-1304 polyurethane foam with air flow of 900–2500 in/min at an inlet pressure of 1.2 inch (water) and may be obtained from Porex Technologies Corp., P.O. Box 100394, Atlanta, Ga. 30384.

I claim:

1. A re-inkable ribbon cartridge for use in a printing device for printing on a sheet of paper, comprising a cartridge having a case with a base member, an exit arm and an entrance arm extending from the base member with a print space between ends of the arms, said case having a bottom wall with an upstanding sidewall extending upwardly from the periphery of the bottom wall, a ribbon storage chamber formed in the base member, an ink ribbon extending from the ribbon storage chamber and through the exit arm, the print space, and the entrance arm to return to the ribbon storage chamber, drive wheel means mounted in the base member for moving the ribbon out of the storage chamber, press wheel ink transfer means for pressing the ribbon against the drive wheel means and for metering ink to the ribbon, an ink reservoir chamber formed in the base member, a foam pad containing ink positioned in the ink reservoir chamber, wick means extending from the foam pad and contacting the press wheel ink transfer means for metering ink by capillary action from the foam ink pad through the wick means and to the press wheel ink transfer means, said wick means being a flat sheet generally rectangular in shape with a reduced portion at its forward end portion, said wick sheet having a lower edge, a positioning notch in said lower edge for positioning the wick sheet in the case, spring means for pressing the wick means against the press wheel ink transfer means to obtain a consistent darkness of print;

said spring means comprising a leaf spring having a positioning notch in its lower edge, and a cover for covering the case.

2. The re-inkable ribbon cartridge of claim 1, said case having a positioning ridge formed on its upper surface for receiving said positioning notch of the spring.

3. The re-inkable ribbon cartridge of claim 1, wherein said foam pad in the reservoir chamber comprises a reticulated polyester polyurethane open pore foam with tensile strength of about 50–110 psi, ultimate elongation of about 350% tear strength of about 5–18 lb/inch, and about 90 pores per linear inch.

4. The re-inkable ribbon cartridge of claim 1, said ink comprising a black matrix ink containing fatty acids, fatty esters, and a black dye, with a viscosity of about 325 cps at 78° F., and a boiling point over 300° F., said ink being insoluble in water.

5. The re-inkable ribbon cartridge of claim 1, said wick means comprising a polyurethane foam with an airflow of about 900–2500 in/min at an inlet pressure of 1.2 inch (water).

6. A re-inkable ribbon cartridge for use in a printing device for printing on a sheet of paper, comprising a cartridge having a case with a base member, an exit arm and an entrance arm extending from the base member with a print space between ends of the arms, said case having a bottom wall with an upstanding sidewall extending upwardly from the periphery of the bottom wall, a ribbon storage chamber formed in the base member, an ink ribbon extending from the ribbon storage chamber and through the exit arm, the print space, and the entrance arm to return to the ribbon storage chamber, drive wheel means mounted in the base member for moving the ribbon out of the storage chamber, press wheel ink transfer means for pressing the ribbon against the drive wheel means and for metering ink to the ribbon, an ink reservoir chamber formed in the base member, a foam pad containing ink positioned in the ink reservoir chamber, wick means extending from the foam pad and contacting the press wheel ink transfer means for metering ink by capillary action from the foam ink pad through the wick means and to the press wheel ink transfer means, said wick means being a flat sheet generally rectangular in shape with a reduced portion at its forward end portion, said wick sheet having a lower edge, a positioning notch in said lower edge for positioning the wick sheet in the case, spring means for pressing the wick means against the press wheel ink transfer means to obtain a consistent darkness of print;

said spring means comprising a leaf spring having a positioning notch in its lower edge, and a cover for covering the case, said spring means comprising a leaf spring having a positioning notch in its lower edge, said case having a positioning ridge formed on its upper surface for receiving said positioning notch of the spring, said foam pad in the reservoir chamber comprising a reticulated polyester polyurethane open pore foam with tensile strength of about 50–110 psi, ultimate elongation of about 350%, tear strength of about 5–18 lb/inch, and about 90 pores per linear inch, said ink comprising a black matrix ink containing fatty acids, fatty esters, and a black dye, with a viscosity of about 325 cps at 78° F., a boiling point over 300° F., said ink being insoluble in water, said wick means comprising a polyurethane foam with an airflow of about 900–2500 in/min at an inlet pressure of 1.2 inch (water).

* * * * *